United States Patent [19]

Göransson

[11] 4,229,007

[45] Oct. 21, 1980

[54] RIM FOR A MINI-GOLF COURSE

[76] Inventor: Jan Göransson, Ekliden 20, Örkelljurga, Sweden 286 00

[21] Appl. No.: 958,695

[22] Filed: Nov. 8, 1978

[30] Foreign Application Priority Data

Nov. 16, 1977 [FR] France ..... 77 34965

[51] Int. Cl.[3] ..... A63B 69/36; A63B 67/02

[52] U.S. Cl. ..... 273/176 B; 52/264; 273/176 J

[58] Field of Search ..... 52/264, 273, 783; 273/176 B, 176 R, 176 E, 176 F, 176 FA, 176 FB, 176 G, 176 H, 176 J, 87 R

[56] References Cited

U.S. PATENT DOCUMENTS

| | | | |
|---|---|---|---|
| 503,913 | 8/1893 | Rasner | 52/264 |
| 2,981,583 | 4/1961 | Eisenberg | 52/264 X |
| 3,858,887 | 1/1975 | Wallin | 52/273 X |
| 4,126,365 | 11/1978 | Bryant | 52/783 X |
| 4,148,490 | 4/1979 | Goransson | 273/176 B |

*Primary Examiner*—George J. Marlo
*Attorney, Agent, or Firm*—John J. Dennemeyer; Arthur Schwartz

[57] ABSTRACT

The present invention relates to a rim for a mini-golf-course for indoor as well as outdoor application. In order to permit indoor application with approximately the same variation of the play as a permanent outdoor course without occupying too large spaces and to permit construction of a simple but stable and strong design for indoor as well as outdoor application without showing the relatively vulnerable and weak structure of course sections of prior art, the rim according to the invention is characterized by a continuous profile element having at least two flange portions turned towards the course, between which are located partly the edge portion of at least one plate forming a play ground, and partly at least one rim element forming the side of a play ground, the edge portion of the plate forming the play ground, and the rim element forming the side of the play ground filling up the space between said flange portions. A corner strip is anchored to the lower flange and located at the juncture of the playground plate and rim element for the purpose of supporting a pivotally mounted obstacle gate. An additional I-shaped support is provided below the playground forming plate.

5 Claims, 3 Drawing Figures

RIM FOR A MINI-GOLFCOURSE

The present invention relates to a rim for a mini-golfcourse, at which the rim can be used for mini-golfcourses for indoor as well as outdoor application.

Mini-golfcourses for indoor application are previously known in various different designs.

In order to be used in indoor application without occupying too large spaces, such mini-golfcourses usually are collapsible or dismountable into sections, and in order to permit approximately the same variation of the play as a plurality of various permanent outdoor courses they further may be combined in various ways. The collapsibility or possibility of dismounting and the possibility of combination of various courses has resulted in that the constructions must be carried out with a limited weight in order to facilitate the handling of the sections or modules forming the course. This, however, involves that the course sections are relatively vulnerable and have a weak construction.

The present invention aims to eliminate the above-mentioned disadvantages of mini-golfcourses according to previously known technique and to permit the construction of mini-golfcourses of a simple but nevertheless stable and strong design for indoor as well as for outdoor application. The rim for a mini-golfcourse according to the invention is characterized by a continuous profile element having at least two flange portions turned towards the course, between which are located partly the edge portion of at least one plate forming a play ground and partly at least one rim element forming the side of the play ground, the edge of the plate forming the play ground, and the rim element forming the side of the play ground filling up the space between said flange portions.

Figure 1:
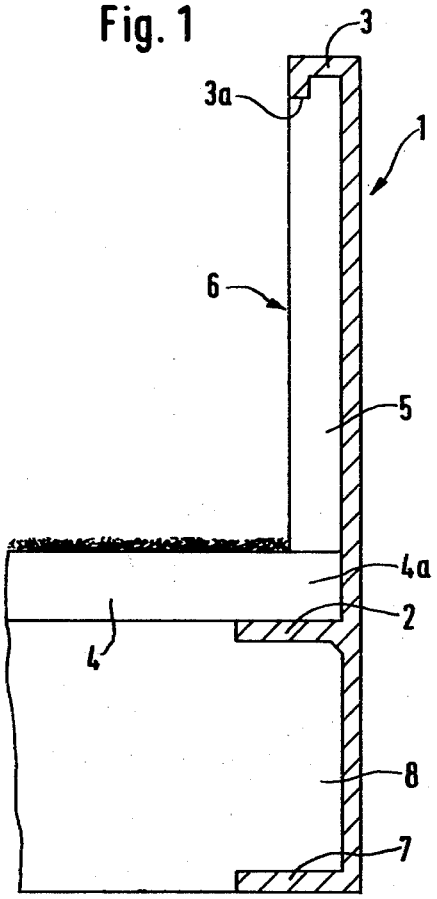
Figure 2:
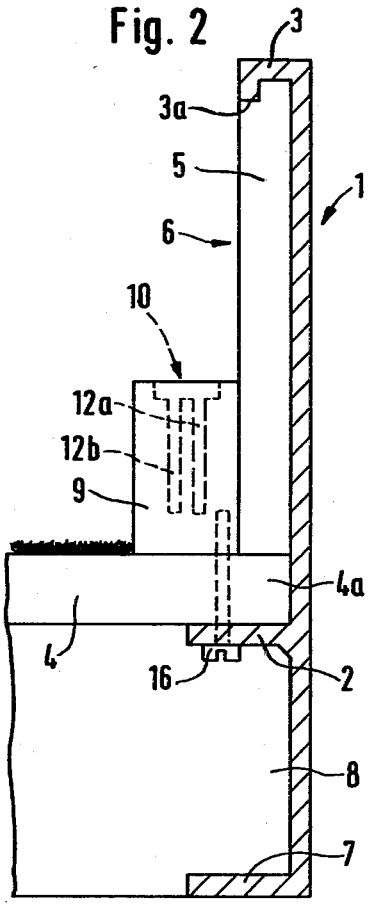
Figure 3:
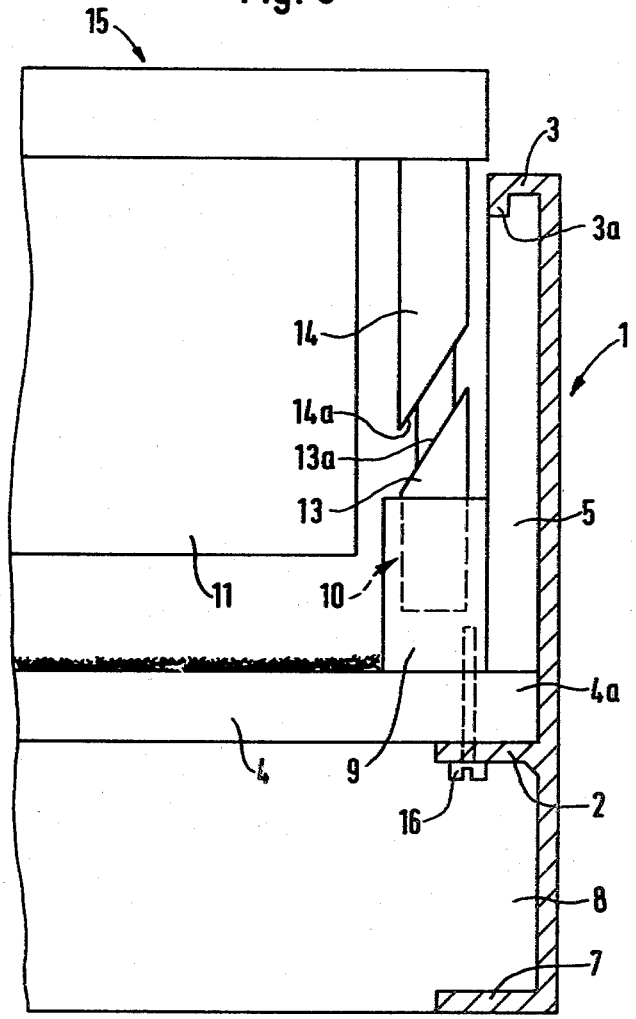

The above-mentioned and other characteristic features of the invention will be more exactly described below with reference to the accompanying drawings in which FIG. 1 is a cross sectional view of a rim according to the invention, preferably for outdoor courses, FIG. 2 shows the rim according to the invention, preferably for indoor courses, and FIG. 3 shows the rim according to FIG. 2 provided with a hinged obstacle.

Thus, as appears from the drawings the present invention relates to a rim for mini-golfcourses for indoor as well as outdoor application. The rim consists of a continuous profile element 1, preferably of aluminum, having at least two flange portions 2 and 3 turned towards the course. Between the flange portions 2,3 are located partly the edge portion 4*a* of at least one plate 4 forming a play ground, and partly at least one rim element 5 forming the side of the play ground, so that the edge portion of the plate forming the play ground, and the rim element forming the side of the play ground fill up the space 6 between the flange portions. The plate 4 and the rim element 5 preferably are formed of a weatherproof laminated material, and further the plate is provided with felt passed thereon to form a play surface. With this construction a strong and bearing course is provided which can be placed directly on the ground without considerable preliminary operations, or directly on the floor, and owing to the choice of material the course will further be almost non-sensitive to wind and weather.

In order to further improve the stability of the course, so that it even will stand walking thereon, the profile element 1 has at least one flange portion 7 located below said flange portions 2,3 and turned in the same direction as said portions, at which between said lower flange portion and the nearest higher located flange portion 2 engages a crossbar profile 8 resting on the foundation, that is the ground or the floor, and extending perpendicularly to the longitudinal direction of the course and serving as a support for the plate 4 forming the play ground. The crossbar profile 8 preferably is made of aluminum and I-shaped with one of the leg portions thereof resting on the foundation whereas the other leg portion supports the plate 4. The crossbar profiles are arranged in the longitudinal direction of the course with suitable intervals of preferably 50–60 centimeters, depending on the desired stability.

In a preferred embodiment of the above-mentioned profile element 1 forming the rim of the two lower flange portions 2,7 have approximately the same size whereas the upper flange portion 3 is considerably narrower and provided with a downward directed edge portion 3*a*. In this way is provided an upper weaker and a lower stronger, U-shaped portion having a high shearing strength which provides a more stable construction. Thus, while the lower U-shaped portion receives the crossbar profile 8, the uppermost flange portion 3 with the downward directed end edge 3*a* forms a downward open space with which the rim element 5 engages in order to have an improved attachement and thereby an even more stable construction.

The rim described in connection with FIG. 1 preferably is suited for outdoor application of permanent courses with permanent obstacles, whereas the rim according to FIGS. 2 and 3 is more suited for indoor application where a course because of lack of space must be assembled in various ways and with different combinations of obstacles, and therefore will require an additional reinforcement. To this end in the rim construction according to FIGS. 2 and 3 is mounted a strip 9 in the corner formed by the plate 4 and the rim element 5 so that they are firmly maintained in their mutual positions.

In order to simply provide a means of attachment for obstacles adapted to be placed above the plate 4 forming the play ground, the corner strip 9 has at least one socket 10 for the anchoring of such obstacles 11. By forming the corner strip 9 with a plurality of sockets 10 a large number of possibilities to combine several obstacles 11 is provided, and one or more obstacles also may be replaced by other suitable obstacles in order to further increase the combination possibilities which of course is advantageous at indoor courses. The socket 10 may consists of holes 12*a* and 12*b*, as shown in FIG. 2, but preferably it consists of a sleeve 13 to receive an anchoring element 14 for a suitable obstacle element 15 (see FIG. 3) hingedly carried in the sleeve. In this embodiment it will be possible to displace the obstacle when it is not used, and by forming the sleeve 13 and the anchoring element 14 with angular contact surfaces 13*a* and 14*a* (FIG. 3) the obstacle at the displacement will be moved upward and adjusted above the corner strip 9 in a position with the obstacle being entirely outside the play ground so that it does not affect the play on the ground.

The rim design according to FIGS. 2 and 3 of course if desired, also may be used for outdoor courses, however outdoor courses usually are provided with permanent obstacles, and therefor the possibility to combine several obstacles and to displace obstacles which are not used, so that they do not affect the play, is not of the same importance as at indoor courses where the space is more limited. It is of course also possible, if desired, to use the rim design according to FIG. 1 for indoor courses.

It is obvious to a person skilled in the art that also other modifications or alterations of the rim according to the invention, than those described above are possible within the scope of the following claims, whithout departing from the concept and purpose of the invention.

What is claimed is:

1. A rim for a mini-golf course comprising:

(a) a continuous profile element having at least two flange portions turned inwardly, (b) a plate having an end portion positioned on one of said flange portions forming a play ground, (c) a rim element extending substantially between said flange portions forming the side of the play ground wherein said plate and said rim element form a corner and substantially fill the space between said flange portions, (d) a corner strip positioned substantially at the juncture of said plate and rim element and being anchored to said one flange portion and said plate element whereby said corner strip is anchored to said rim and retains said rim element against said profile.

2. A rim according to claim 1, wherein the profile element further has at least one lower flange portion located below said flange portions and turned in the same direction as said two flange portions, a crossbar profile positioned between said lower flange portion and said one flange portion, said crossbar profile extending substantially perpendicular to the longitudinal direction of the course and forming a support for the plate forming the play ground.

3. A rim according to claim 1 or 2, wherein the uppermost flange portion has a downwardly directed end edge forming a downward open space into which the rim element is positioned.

4. A rim according to claim 1, wherein said corner strip has at least one socket for anchoring an obstacle adapted to be positioned above said plate forming the play ground.

5. A rim according to claim 4, wherein said socket comprises a sleeve for receiving an anchoring element for an obstacle organ hingedly carried in said sleeve.

* * * * *